US006760992B2

(12) United States Patent
Brosow

(10) Patent No.: US 6,760,992 B2
(45) Date of Patent: Jul. 13, 2004

(54) ELECTRONIC SECURITY DEVICE FOR A FIREARM AND ASSOCIATED ELECTRONICALLY CODED AMMUNITION

(75) Inventor: Joergen Brosow, Plainfeld 156, 5322 Hof (AT)

(73) Assignees: Joergen Brosow, Hof (AT); Infineon Technologies AG, München (DE)

( * ) Notice: Subject to any disclaimer, the term of this patent is extended or adjusted under 35 U.S.C. 154(b) by 0 days.

(21) Appl. No.: 10/257,517

(22) PCT Filed: Apr. 12, 2001

(86) PCT No.: PCT/EP01/04216

§ 371 (c)(1),
(2), (4) Date: Oct. 11, 2002

(87) PCT Pub. No.: WO01/79777

PCT Pub. Date: Oct. 25, 2001

(65) Prior Publication Data

US 2003/0097776 A1 May 29, 2003

(30) Foreign Application Priority Data

Apr. 13, 2000 (DE) ..... 100 18 369

(51) Int. Cl.[7] ..... F41A 17/06
(52) U.S. Cl. ..... 42/70.06; 42/70.04
(58) Field of Search ..... 42/70.01, 70.05, 42/70.06, 70.08, 70.11, 70.04

(56) References Cited

U.S. PATENT DOCUMENTS

| | | | | |
|---|---|---|---|---|
| 4,354,189 A | * | 10/1982 | Lemelson | 340/543 |
| 4,488,370 A | * | 12/1984 | Lemelson | |
| 5,001,962 A | | 3/1991 | Schlegel et al. | 89/6.5 |
| 5,212,339 A | | 5/1993 | Piltch | 102/202 |
| 5,303,495 A | | 4/1994 | Harthcock | 42/84 |
| 5,459,957 A | | 10/1995 | Winer | 42/70.11 |
| 5,461,812 A | * | 10/1995 | Bennett | 42/70.11 |
| 5,502,915 A | | 4/1996 | Mendelsohn et al. | 42/70.11 |
| 5,915,936 A | | 6/1999 | Brentzel | 42/70.11 |
| 6,223,461 B1 | * | 5/2001 | Mardirossian | 42/70.11 |
| 6,282,829 B1 | * | 9/2001 | Mossberg et al. | 42/70.11 |
| 6,283,034 B1 | * | 9/2001 | Miles, Jr. | 102/430 |
| 6,314,671 B1 | * | 11/2001 | Gering | 42/70.11 |
| 6,510,642 B2 | * | 1/2003 | Riener | 42/70.11 |

FOREIGN PATENT DOCUMENTS

| | | |
|---|---|---|
| DE | 195 41 647 A1 | 5/1996 |
| GB | 1377398 | 12/1974 |
| WO | 9804880 | 2/1998 |
| WO | 0047942 | 8/2000 |

* cited by examiner

*Primary Examiner*—Stephen M. Johnson
(74) *Attorney, Agent, or Firm*—Friedrich Kueffner

(57) ABSTRACT

An apparatus for releasing a safety device of a firearm with a trigger for actuating the apparatus, wherein the safety device is capable of blocking the actuation of the apparatus. The safety device is provided at the firearm with a source of electric energy and an electronic circuit energized by the source of electric energy. The electronic circuit includes a transmitter for wirelessly transmitting an interrogation signal to a transponder provided separately from the firearm, a receiver for receiving a response signal wirelessly transmitted from the transponder in response to the interrogation signal, a device for examining information contained in the response signal, a releasing device driven by the examining device and deblocking the actuation of the apparatus depending on the examination result, and a non-volatile memory having an identification code for the firearm stored therein. The examination device includes a comparator device for comparing the code stored in the non-volatile memory with the information contained in the response signal transmitted from the transponder. The non-volatile memory is exchangeable and the remaining components of the electronic circuit are fixedly connected with the firearm.

6 Claims, 2 Drawing Sheets

FIG. 2a.
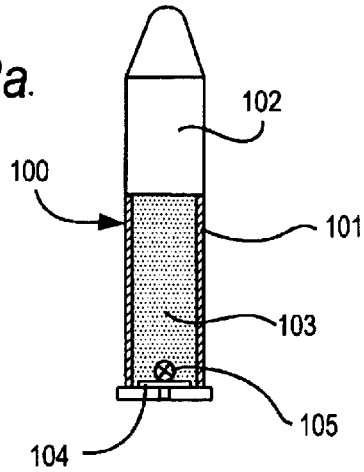
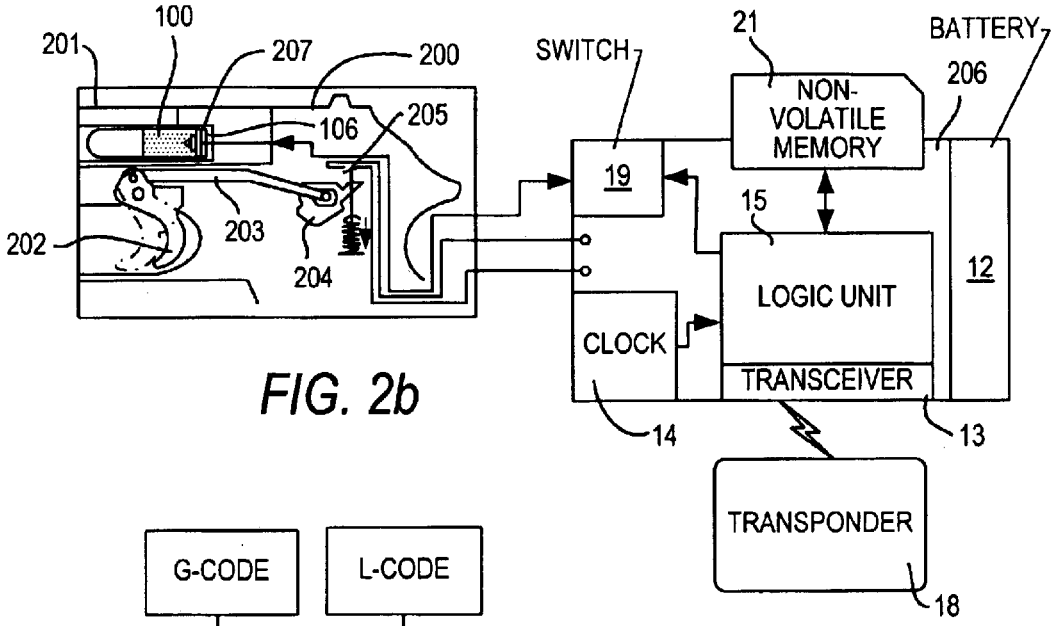
FIG. 2b
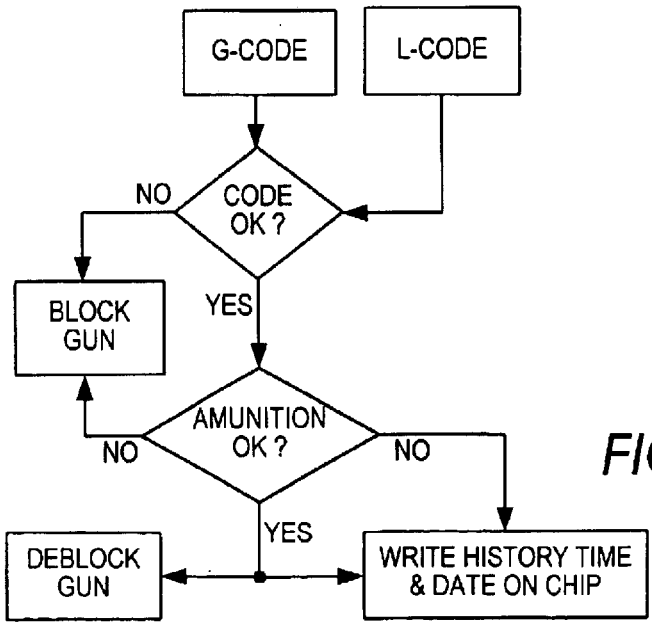
FIG. 2c

ELECTRONIC SECURITY DEVICE FOR A FIREARM AND ASSOCIATED ELECTRONICALLY CODED AMMUNITION

BACKGROUND OF THE INVENTION

1. Field of the Invention

The invention relates to an apparatus for releasing a shot from a firearm comprising a trigger for actuating said apparatus and a safety device capable of blocking said actuation of said apparatus, and further relates to ammunition and to a firearm usable with said ammunition.

2. Description of the Related Art

Worldwide attempts to tighten up the laws ruling the use of firearms impressively illuminate the immense potential of risk resulting from the use of firearms by non-authorized people. Heretofore known safety devices at firearms may at most decrease the risk that a user by an inadvertent actuation of the trigger of the firearm unintentionally fires the shot. They can, however, not prevent unauthorized people from actuating the firearm at any time. On the one hand firearms, like pistols, revolvers or rifles, when they get into the hands of children, are, a great source of risk. On the other hand, firearms are abused by criminals to threaten, wound or even kill other people. Not seldom it even happens that security personal is shot by their own firearm they have for office use but was taken into possession through peculiar circumstances by a criminal.

SUMMARY OF THE INVENTION

It is an object of the invention to provide an apparatus of the above referenced type which enables to protect the firearm against unauthorized use. It is a further object to propose ammunition which is suitable for this purpose and to propose a firearm suitable for use with this ammunition.

With regard to an apparatus for releasing a shot of the above referenced type this object is obtained in that said safety device is provided with, at said firearm, a source of electric energy and an electronic circuit energized by said source of electric energy, said electronic circuit comprising a transmitter for wirelessly transmitting an interrogation signal to a transponder provided separately from said firearm, a receiver for receiving a response signal wirelessly transmitted from said transponder in response to said interrogation signal, a device for examining information contained in said response signal, and a releasing device driven by said examining device and deblocking said actuation of said apparatus depending on the examination result.

According to the invention the firearm remains blocked against releasing a shot unless the user of the firearm has the transponder about himself which, after the actuation of the trigger of the firearm, in response to the interrogation signal transmitted from the circuit of the firearm retransmits the response signal which enables the releasing apparatus to be deblocked. Transponders suitable for this purpose are known. They have a receiver for the interrogation signal and a transmitter for the response signal and recover the necessary electric energy for their operation from the transmitted interrogation signal.

The electronic circuit and the source of electric energy will in the case of small arms be preferably arranged in the handle of the firearm. The source of electric energy will regularly be a battery. In this aspect other embodiments are also conceivable. For instance a transducer mechanically coupled to the trigger could be used as the source of electric energy, said transducer transforming the mechanical motion of the trigger when releasing a shot into electric energy.

As in the case of conventional mechanical safety devices the safety device in the present invention is also normally blocked. For this no electric energy is thus necessary. Consumption of electric energy will only occur when the trigger is actuated and the signal exchange between the firearm and the transponder causes a mechanical block pin blocking the safety device to be shifted into a release position thereof, for instance by means of a solenoid provided in the releasing device.

In a preferred embodiment it is provided that said electronic circuit of said firearm comprises a non-volatile memory having an identification code for said firearm stored therein, and said examination device comprises a comparator device for comparing said code stored in said non-volatile memory with the information contained in said response signal transmitted from said transponder. The code stored in the non-volatile memory individualizes the firearm. The latter one may therefore only be used by those being in position of a transponder whose response signal has a relationship to the stored code which is accepted by the comparator device to deblock the releasing device.

In relation to this it is a useful further development that said non-volatile memory has additionally stored therein a code representative of a firearm user license, said code being compared by said comparator device with the information contained in the response signal transmitted from said transponder. The code representing the firearm user license allows to individualize the persons being authorized to use the firearm in the manner of a license number. In this way a plurality of codes for a plurality of persons may be stored resulting in that this firearm may be used by a group of several persons. Nevertheless, each person has his own transponder which only transmits a response signal corresponding to the code which is valid for this very person. In this case, when the trigger is actuated, the comparator device cycles through all codes all representing the different user licenses until a valid code is found. Only, in the latter case the releasing apparatus is deblocked. Otherwise it remains blocked.

In this relation it is also of advantage that said non-volatile memory is exchangeable and said remaining parts of said electronic circuit are fixedly connected with said firearm. The non-volatile memory which individualizes the firearm is in this case for instance located on a substrate which is inserted into a corresponding recess in the magazine of the firearm. When sliding the magazine into the firearm the non-volatile memory is contacted with the circuit and thereby individualizes the firearm which is otherwise of the same construction as all the other firearms of the same type.

Within the scope of the invention it is further provided that said electronic circuit of said firearm comprises a real time clock, a non-volatile memory and a memory write unit, said memory write unit writing time and date of each actuation of the apparatus into said non-volatile memory. This constitution, while requiring a permanent supply of electric energy for the real time clock, permits to record all actuations of the firearm. This provides for an extremely effective means to examine each use of the firearm for criminalistic or other purposes. In order to prevent tempering of the time or date records, provisions have to be made that the supply of power for the real time clock can at least not unperceivedly be interrupted. For this purpose the electronic circuit may be provided with a function which permanently blocks the firearm in case of an interruption of the supply of power for the real time clock. Removal of this permanent block with practically feasible expense is then only possible through the manufacturer.

Preferably, the electronic circuit of the firearm will be in the form of a microchip as is known in the state of the art. The form of microchip is above all also advantageous for the transponder in a specific embodiment of the apparatus. In this embodiment of the apparatus the transponder is in the form of a chip and is integrally arranged with an item a user of the firearm has to have about oneself.

This object may have various forms which enable it to be unobtrusively worn at the body or also without any appreciable risk to be lost. The transponder chip may for instance be inserted into a flat substrate in the manner of a known chip card which the user wears in a pocket of his clothing. A particularly useful embodiment having the advantage of a small transmission distance between the transponder and the fire arm resides in that the object is a finger ring. Where this finger ring is worn at the shooting hand, an inductive transmission of the interrogation signal and the response signal is for instance sufficient due to the short distance.

The object of increasing the safety of a firearm is also promoted by the creation of ammunition comprising a cartridge-case, a bullet plugging said cartridge-case, a propelling charge arranged in said cartridge-case, and a firing device for said propelling charge provided at said cartridge-case, said ammunition being characterized in that said firing device comprises an electronic circuit having an electric contact arrangement adapted for contacting a complementarily formed contact arrangement of said firearm, when said ammunition is in a firing position, for supplying electric energy from said firearm and a transducer driven by said electronic circuit, said transducer transforming a pulse of electric ignition energy supplied from said circuit to said transducer in response to the supply of energy into a pulse of energy suitable for firing said propelling charge.

This type of ammunition cannot be used with hitherto known firearms since the firing device thereof in contrast to conventional detonators cannot be fired by the firing pins of conventional firearms. If only care will be taken that the future production of ammunition is completely changed over to the ammunition in accordance with the invention, all conventional small arms which are at a large degree disseminated without any control will after a short time become unusable. The ammunition in accordance with the invention requires the supply of electric ignition energy which is converted by the electronic circuit provided within the ammunition into a signal form suitable for driving the transducer which causes conversion into an energy pulse suitable for firing the propelling charge. Regularly this will be an electrothermical transducer supplying a sufficient amount of thermic energy to fire the propelling charge. Preferably, the transducer is a laser diode which due to its single use may be driven beyond a destructive power thereof.

An advantageous embodiment of the ammunition resides in that said electronic circuit of said firing device comprises a non-volatile memory having a code identifying the type of ammunition stored therein and being readable via said contact arrangement.

When the identification code is read out it may be used to control the admissibility of the ammunition for a certain firearm or also for a certain user.

For the use of the ammunition a firearm comprising an apparatus for releasing a shot, said apparatus having a contact arrangement formed complementarily to said electric contact arrangement of said ammunition and having a trigger, is embodied so that said releasing apparatus is provided with a source of electric energy and an electronic circuit energized by said source of electric energy, said electronic circuit supplying appropriate electric energy for firing said ammunition to said complementarily formed contact arrangement in response to an actuation of said trigger.

For exploiting the controllability provided by the code which identifies the type of ammunition the above embodiment of the firearm is further formed so that said electronic circuit of said firearm comprises a device for reading said identification code stored in the non-volatile memory of the electronic circuit of said ammunition and a device for examining said identification code, said examination device releasing or blocking said supply of energy depending on the result of the examination. In this way the firearm may for instance be prevented from being used with inappropriate ammunition which may for instance result in a dangerous expansion of the barrel.

An additional increase in controllability is attained in that said electronic circuit of said firearm comprises a non-volatile memory, said read out identification code of said ammunition being stored into said non-volatile memory. In this way it can be determined in later examinations what type of ammunition has been used with the firearm. The use of forbidden types of ammunition may in this way later be determined and thereby premature wear and resulting accidents may be uncovered.

BRIEF DESCRIPTION OF THE DRAWINGS

Further features, particulars and advantages of the invention ensue from the following description and the drawings. There is shown in.

DETAILED DESCRIPTION OF THE PREFERRED EMBODIMENTS

Figure 1A:
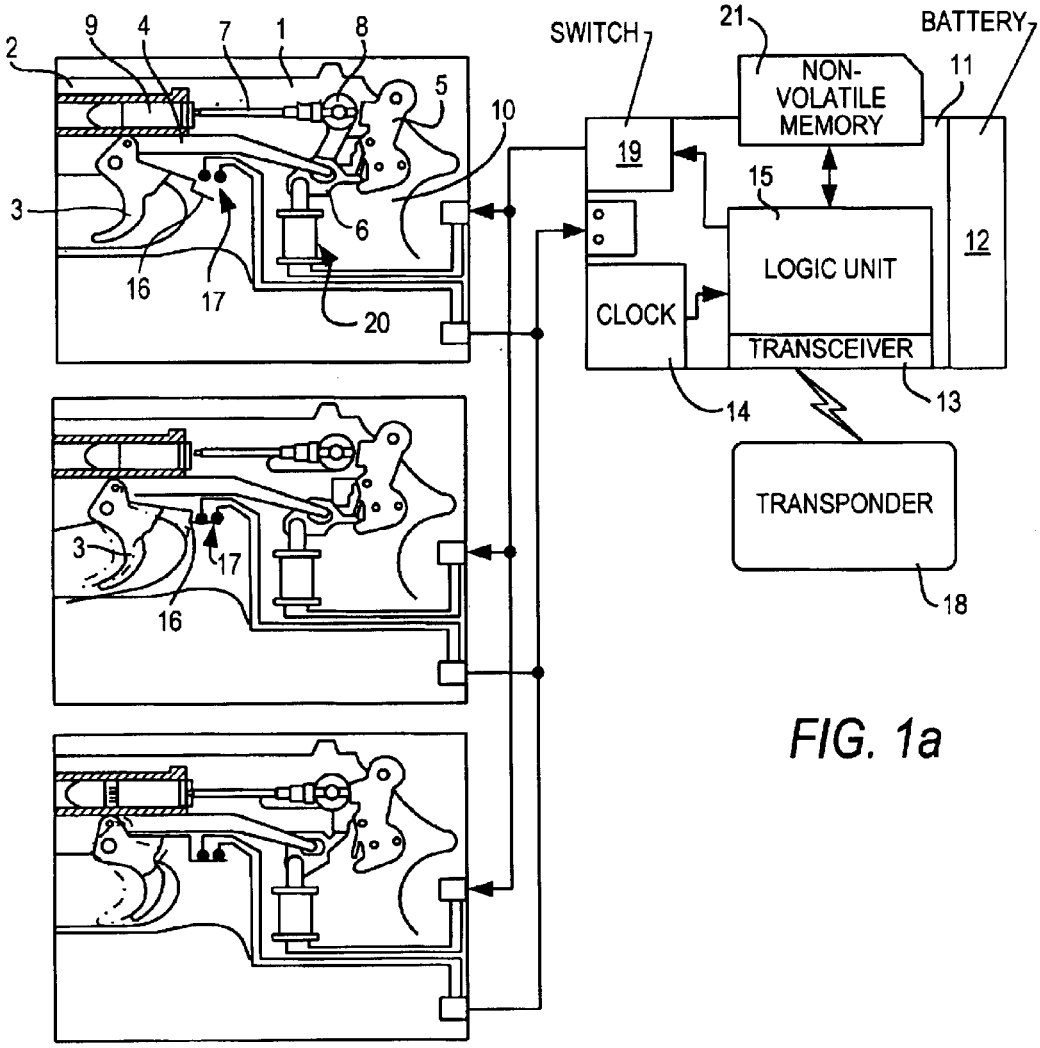
FIG. 1(*a*) a schematic representation of an apparatus for releasing a shot from a firearm in three different phases, namely before the trigger is actuated, when the trigger is partly actuated and when the trigger is fully actuated, FIG. 1(*b*) an operational flow chart of the apparatus illustrated in FIG. 1(*a*), FIG. 2(*a*) a schematic cross-section through a cartridge, FIG. 2(*b*) an apparatus for releasing a shot configured for use with the cartridge of FIG. 2(*a*), and FIG. 2(*c*) an operational flow chart of how the cartridge of FIG. 2(*a*) cooperates with the releasing apparatus of FIG. 2(*b*).
Figure 1B:
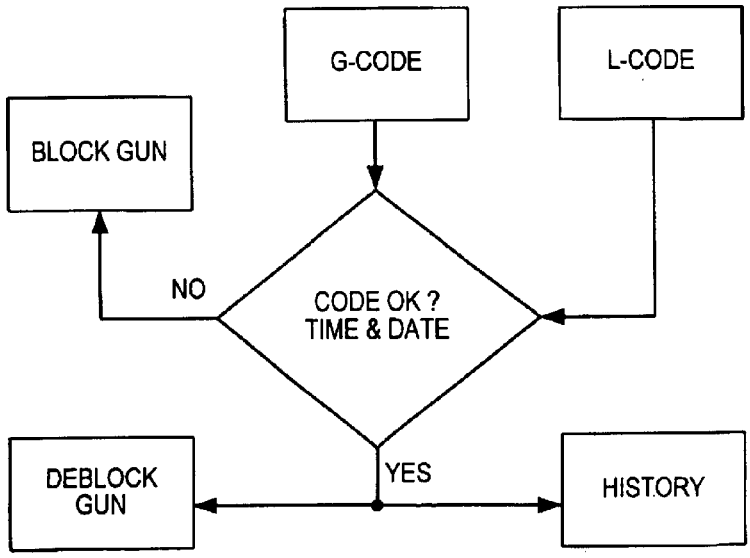

The upper left of FIG. 1(*a*) schematically shows the outline of a pistol 1 in the region of the end of its barrel 2 which is adjacent to the grip. Within the outline the apparatus for releasing a shot is schematically illustrated. The apparatus comprises a trigger 3, a trigger bar 4 linked thereto, a cock 5, a cock blocking member 6 arranged between the cock 5 and the end of the trigger bar 4 which is removed from the trigger 3, the cock blocking member 6 being actuatable by the trigger bar 4, a firing pin 7 and a safety lever 8 for the firing pin. Such a mechanical constitution of the releasing apparatus is widely known in the state of the art and no further description is for this reason given herein. It is only to be noted that the cock blocking member 6 is being pivoted by the trigger bar 4 when pulling the trigger 3 in known manner so as to release the spring biased cock 5 which thereby strikes the firing pin 7 against the detonator of the cartridge 9 located in the barrel 2, if the safety lever 8 is in a released position. This condition is represented in the lowermost picture at the left side of FIG. 1(*a*).

In the grip portion 10 of the pistol 1, only the uppermost portion thereof being represented in FIG. 1(*a*), an electronic circuit 11 is arranged which is for easier illustration represented outside the grip portion 10 while it is in reality for instance mounted within a grip shell of the grip portion 10.

The electronic circuit 11 comprises a battery 12 serving as a source of electric energy, a transceiver circuit 13, a real time clock 14 and a logic unit 15 which coordinates the operation of the whole circuit.

The trigger 3 comprises an actuation element 16 for a built-in micro switch 17. As soon as the trigger 3 in order to shoot is initially pulled for a small distance, the actuation element 16 closes the micro switch 17. This condition is illustrated in the central picture at the left side of FIG. 1(*a*). Thereby the logic unit 15 is switched on via a switch-on signal from the micro switch 17 appearing over the input contacts S1, S2 of the logic unit 15 and causes the transmitter of the transceiver circuit 13 to wirelessly transmit an interrogation signal.

The interrogation signal is received by a transponder 18 which is worn by the user separately from the pistol 1. The transponder 18 is for instance embodied in the form of a microchip and is integrated into a finger ring which is worn by the user of the pistol 1 at his shooting hand.

The transponder responds in a known manner to the received interrogation signal by transmitting a predetermined response signal. This is received by the receiver of the transceiver circuit 13 of the circuit 11 and is demodulated for the information contained therein. The logic unit 15 comprises an examination device which examines the contained information for a predetermined criterion and drives a releasing device which upon compliance with the criterion deblocks the actuation of the releasing apparatus. The releasing device is exemplarily illustrated in FIG. 1*a* as a switch 19 driven by the logic unit 15, said switch 19 supplying a solenoid 20 associated with the cock blocking member 6 with an electric energization pulse with result that the solenoid 20 pulls a locking pin normally being in locking engagement with the cock blocking member 6 out of engagement and thereby releases the cock 5 while the trigger 3 is further pulled, which causes that the shot is released.

As the criterion for the examination of the information contained in the response signal and for deblocking the releasing apparatus a comparison with a code stored in a non-volatile memory 21 is used in the embodiment illustrated in FIG. 1(*a*). After receipt of the response signal by the transponder 18 the logic unit 15 reads the stored code from the non-volatile memory 21 and compares the code with the information contained in the response signal. Only for the case that a predetermined relation between the information contained in the response signal and the read out code of the firearm is determined in this comparison, for instance identity, deblocking occurs through the releasing device.

In the representation of FIG. 1(*a*) it is indicated that the non-volatile memory 21 is arranged separately from the remaining portions of the electronic circuit on a flat carrier substrate, for instance a small chip card. This chip card is for instance inserted into a recess in the magazine of the firearm and is contacted with the remaining portion of the electronic circuit when the magazine is slid in.

If only one single code is stored in the non-volatile memory 21 of the firearm, this code at the same time identifies the firearm and the transponder 18 which transmits the corresponding response signal in the manner of a user license of the owner of the transponder 18. It may, however, also be provided that additionally one or a plurality of codes identifying a firearm user authorization are stored in the non-volatile memory 21 of the firearm. In this case a corresponding plurality of transponders 18 may be associated with the firearm, each transponder transmitting one of said codes representing a user authorization as the response signal. If the response signal representing one of these codes is received from one of these transponders, the electronic circuit 11 successively compares this response signal with all stored authorization codes and deblocks the releasing apparatus as soon as for one of these comparisons the corresponding criterion is met. If this will not be met for any of the stored authorization codes the fire arm remains blocked. In this way it can be used by a well-defined group of users while it cannot be used by any other person.

This way of operation is summarily illustrated in the operational flow chart of FIG. 1(*b*). There the block "L-Code" designates the transfer of the information contained in the response signal of the transponder 18 and representing the user authorization into the logic unit 15. The block "G-Code" represents that the code stored in the non-volatile memory 21 of the firearm is read into the logic unit 15. The block "Code ok?/Time & Date" symbolizes the comparison of the code transferred by the transponder 18 with the code stored in the non-volatile memory 21 of the firearm and the fact that the logic unit 15 takes over time and date from the real time clock 14. The block "block gun" symbolizes that the firearm remains blocked if the code comparison does not fulfill the predetermined criterion. The blocks "deblock gun" and "History" symbolize that the releasing apparatus of the firearm is deblocked and moreover time and date of release are written into the non-volatile memory. 21 of the firearm if the criterion is complied with.

In the embodiment illustrated in FIGS. 1(*a*) and (*b*) the cartridge 9 is in a conventional way fired by the abutment of the firing pin 7 onto a detonator of the cartridge 9. This is no longer the case with the embodiment of a cartridge 100 illustrated in FIG. 2(*a*). The latter one, it is true, comprises in the same way as conventional ammunition a cartridge case 101 blocked at the front end thereof by a bullet 102 and accommodating a propelling charge 103.

In contrast to conventional ammunition which is provided at the rear end of the cartridge case 101 with a detonator, an electronic circuit 104 is arranged at the rear end in the cartridge case 101 of the cartridge 100 and has a laser diode 105 formed at the side thereof which faces to the propelling charge 103. From the side of the circuit 104 which is opposite to the laser diode 105 a contact arrangement 106 extends to the outer side.

When the contact arrangement 106 which may for instance form a bus contact, is supplied with electric energy in a sufficient amount, the circuit 104 is activated and supplies an electric, pulse of ignition energy to the laser diode 105. Since this occurs only once, laser diode 105 may be overdriven beyond its destruction limit. The laser diode 105 transforms this pulse of electric ignition energy into a thermal pulse appropriate for firing the propelling charge 103. In this way the propelling charge 103 and the bullet 102 are fired.

In addition to the components which are necessary to form the electric pulse of ignition energy the electronic circuit 104 may be provided with a non-volatile memory the contents of which may be read out at the contact arrangement 106. At the time of manufacturing the ammunition a code identifying the type of ammunition is written into the non-volatile memory, for instance whether it is high-speed ammunition or not. When constituting the firearm using the ammunition 100 in a suitable manner, this code may in various ways be used for the use of the firearm.

A basic embodiment of a firearm for use with the ammunition illustrated in FIG. 2(*a*) is schematically illustrated in FIG. 2(*b*). Similar to the illustration of FIG. 1(*a*) the outline of the pistol 200 in the region of the rear end of its barrel 201 and the upper end of its grip portion is represented in FIG. 2(*b*). Similar to FIG. 1(*a*) there is again indicated the trigger 202, the trigger bar 203 linked thereto and the cock blocking member 204 actuated by the trigger bar 203. Different from FIG. 1(*a*) the remaining mechanical parts necessary to release a shot are in this embodiment not present.

In particular there does not exist a firing pin and a cock for driving the firing pin. Instead, the cock blocking member 204 actuates an electronic micro switch 205 which switches on an electric circuit 206 built into the grip portion of the pistol 200. In FIG. 2(*a*) the circuit 206 is solely for the purpose of easier representation illustrated outside the grip portion.

The circuit 206 corresponds in its constitution and function completely to the circuit 11 which has been described above in connection with FIG. 1(*a*). Therefore corresponding parts of the circuit 206 in FIG. 2(*b*) are designated with the same reference numerals as in FIG. 1(*a*). Reference is insofar made to the description of FIG. 1(*a*). It is only to be noted supplementarily that the effect of switching on the switch 16, 17 in FIG. 1(*a*) corresponds to the effect of switching on the switch 205 in FIG. 2(*b*). However, in FIG. 2(*b*) a switch of the type of switch 16, 17 in FIG. 1(*a*) could as well be used. A functional difference resides however in that instead of driving the solenoid 20 in FIG. 1(*a*), the circuit 206 in FIG. 2(*b*) drives the contact arrangement 106 of the cartridge 100 positioned ready for firing within the barrel 201 of pistol 200. For this purpose a contact arrangement 207 formed complementarily to contact arrangement 106 is provided at the end of the barrel 201, said complementarily formed contact arrangement 207 providing electrical connection with the circuit 206. Via this connection the circuit 206 of the pistol 200 reads the code identifying the type of ammunition from the non-volatile memory of the circuit 104 arranged within the cartridge case 101 and also supplies the circuit 104 which is internal to the cartridge with electrical energy necessary for its operation, in particular energy necessary for firing.

The logical operational diagram of FIG. 2(*c*) summarizes the whole operation. The block "L-Code" symbolizes the takeover of the information contained in the response signal of the transponder 18 by the logic unit 15. Similarly, the block "G-Code" symbolizes that the logic unit 15 reads out the code stored in the non-volatile memory 21 of the circuit 206. By the block "Code ok?" it is represented that the logic unit 15 mutually compares both codes and in case of noncompliance with the predetermined criterion of comparison, for instance identity, maintains the firearm blocked as is symbolized by the block "block gun". The hitherto described flow of operation completely corresponds to the description of the flow of operation with reference to FIG. 1(*b*) for the embodiment illustrated in FIG. 1(*a*).

The block "Ammunition ok?" designates the function of the embodiment of FIG. 2(*b*) which is in excess over the embodiment of FIG. 1(*a*). Namely, if the code comparison leads to a positive result, the logic unit 15 reads the code identifying the type of ammunition out of the non-volatile memory of the circuit 104 of the cartridge 100. The read out ammunition code is examined in accordance with a predetermined criterion. If this is not complied with, the firearm remains blocked as indicated by the block "block gun". Moreover, in this case the read out ammunition code together with date and time of read out is written into the non-volatile memory 21 of the circuit 206 in the firearm. This is symbolized by the block "write History Time & Date on Chip".

Where in contrast the examination of the read out ammunition code ends with a positive result, the circuit 206 of the firearm causes the circuit 104 of the ammunition to fire the laser diode 105. This is symbolized by the block "deblock gun" in FIG. 2(*c*). At the same time the read out ammunition code together with time and date of read out is written into the non-volatile memory 21 of the circuit 206 in the firearm (see block "write History Time & Date on Chip").

List of Reference Numerals

1 pistol
2 barrel
3 trigger
4 trigger bar
5 cock
6 cock blocking member
7 firing pin
8 safety lever
9 cartridge
10 grip portion
11 electronic circuit
12 battery
13 transceiver circuit
14 real time clock
15 logic unit
16 actuation element
17 micro switch
18 transponder
19 switch
20 solenoid
21 non-volatile memory
100 cartridge
101 cartridge case
102 bullet
103 propelling charge
104 electronic circuit
105 laser diode
106 contact arrangement
200 pistol
201 barrel
202 trigger
203 trigger bar
204 cock blocking member
205 micro switch
206 electric circuit
207 complementarily formed contact arrangement

What is claimed is:

1. Apparatus for releasing a safety device of a firearm comprising a trigger for actuating said apparatus, the safety device being capable of blocking said actuation of said apparatus, wherein said safety device is provided with, at said firearm (1), a source of electric energy (12) and an electronic circuit (11) energized by said source of electric energy (12), said electronic circuit (11) comprising a transmitter (13) for wirelessly transmitting an interrogation signal to a transponder (18) provided separately from said firearm (1), a receiver (13) for receiving a response signal wirelessly transmitted from said transponder (18) in response to said interrogation signal, a device (15) for examining information contained in said response signal, a releasing device (19, 20) driven by said examining device (15) and deblocking said actuation of said apparatus depending on the examination result, and a non-volatile memory (21) having an identification code for said firearm (1) stored therein, wherein said examination device (15) comprises a comparator device for comparing said code stored in said non-volatile memory (21) with the information contained in said response signal transmitted from said transponder (18), wherein said non-volatile memory (21) is arranged separately from said transmitter (13), said receiver (13), said examining device (15) and said releasing device (19, 20) of the electronic circuit on a flat carrier substrate which is exchangeable and said transmitter (13), said receiver (13), said examining device (15) and said releasing device (19, 20) of said electronic circuit (11) are fixedly connected with said firearm (1).

2. Apparatus according to claim 1, wherein said non-volatile memory (21) has additionally stored therein a code representative of a firearm user license, said code being compared by said comparator device with the information contained in the response signal transmitted from said transponder (18).

3. Apparatus according to claim 1, wherein said electronic circuit (11) of said firearm (1) comprises a real time clock (14) and a memory write unit, said memory write unit writing time and date of each actuation of the apparatus into said non-volatile memory (21).

4. Apparatus according to claim 1, wherein said transponder (18) is in the form of a chip and is integrally arranged with an item a user of the firearm (1) has to have about oneself.

5. Apparatus according to claim 4, wherein said item is a finger ring.

6. Apparatus according to claim 2, wherein said flat carrier is a chip card.

* * * * *